US007287405B2

(12) United States Patent
Brown

(10) Patent No.: US 7,287,405 B2
(45) Date of Patent: Oct. 30, 2007

(54) DRILL RESISTANT LOCK

(75) Inventor: Peter Mark Brown, Farnborough (GB)

(73) Assignee: Qinetiq Limited (GB)

( * ) Notice: Subject to any disclaimer, the term of this patent is extended or adjusted under 35 U.S.C. 154(b) by 0 days.

(21) Appl. No.: 10/479,737

(22) PCT Filed: Jun. 5, 2002

(86) PCT No.: PCT/GB02/02311

§ 371 (c)(1),
(2), (4) Date: Dec. 5, 2003

(87) PCT Pub. No.: WO02/099230

PCT Pub. Date: Dec. 12, 2002

(65) Prior Publication Data

US 2004/0148990 A1 Aug. 5, 2004

(30) Foreign Application Priority Data

Jun. 6, 2001 (GB) ..... 0113712.4

(51) Int. Cl.
*E05B 15/16* (2006.01)

(52) U.S. Cl. ..... 70/417

(58) Field of Classification Search ..... 70/417, 70/1, 1.5, 1.7, 333 R, 416, 418; 292/2
See application file for complete search history.

(56) References Cited

U.S. PATENT DOCUMENTS 881,031 A * 3/1908 Schultz ..... 109/81
1,446,589 A * 2/1923 Shaw ..... 70/417
2,938,374 A * 5/1960 Criscuolo et al. ..... 70/333 R
3,205,841 A 9/1965 Shwayder
3,659,885 A * 5/1972 Nail ..... 292/2
3,799,592 A 3/1974 Babb, Jr. et al.
3,976,434 A * 8/1976 Shwayder ..... 428/556
4,446,707 A 5/1984 Mullich et al.
4,509,350 A * 4/1985 Gartner ..... 70/333 R (Continued)

FOREIGN PATENT DOCUMENTS

AT 336 436 5/1977

(Continued)

OTHER PUBLICATIONS

Search Report from UK Patent Office of Application No. GB 0113712.4.

(Continued)

*Primary Examiner*—Lloyd A. Gall
(74) *Attorney, Agent, or Firm*—McDonnell Boehnen Hulbert & Berghoff LLP

(57) ABSTRACT

A drill resistant lock (30) comprises a bolt member (33) for fitting into a similar sized and shaped slot (35) to secure closure of entry to a property, a locking mechanism (31, 32) associated with a bolt member (33), whereby release and/or closure of the bolt member (33) into the slot (35) is effected by insertion and rotation of an appropriate key in the locking mechanism (31, 32), wherein the bolt member (33) is provided with a core (34) containing a material with different mechanical properties to the main body of the bolt member (33), the material of the core (34) being more drill resistant than the material of the main body.

20 Claims, 4 Drawing Sheets

U.S. PATENT DOCUMENTS

| | | | | | |
|---|---|---|---|---|---|
| 4,561,272 | A | * | 12/1985 | Goldstein | 70/417 |
| 5,490,468 | A | | 2/1996 | Polensky | |
| 5,678,432 | A | | 10/1997 | Teskey | |

FOREIGN PATENT DOCUMENTS

| | | |
|---|---|---|
| DE | 364029 | 11/1922 |
| DE | 200 20 623 | 3/2001 |
| FR | 2 740 498 | 4/1997 |
| GB | 1338720 | 11/1973 |
| GB | 1392268 | 4/1975 |

OTHER PUBLICATIONS

International Search Report from the European Patent Office for Application No. PCT/GB02/02311.
Science of New Materials, (1992) Introduction and Figure 3.1.

* cited by examiner

DRILL RESISTANT LOCK

BACKGROUND OF THE INVENTION (1) Field of the Invention

This invention relates to improvements in the security of locks, for example, but not limited to mortise locks. In particular, the invention relates to a novel deadbolt for use in locks, the novel deadbolt having improved resistance to attack by persons attempting unauthorised access to a secure area.

(2) Description of the Art

It is not uncommon for persons to gain unauthorised access to a domestic or business property by destroying a lock on the external door to the property. Typically a lock will comprise a bolt member associated with a keyhole mechanism which, when the lock is closed, fits into a similarly sized slot. The bolt member may then be released from the slot when an appropriate key is fitted in the keyhole and turned in an appropriate manner. One means by which unscrupulous persons gain unauthorised access is by machining into soft materials surrounding the slot and destroying the bolt. For example, where the lock is a mortise lock securing an external door to a domestic property, an unscrupulous person may drill through the door frame into which the dead bolt of the lock fits and penetrate the metal (typically brass) of the deadbolt. The deadbolt is destroyed and the door may be freely opened.

At present, in the UK, insurance premiums for domestic properties may be reduced where the external doors of the property are secured by locks which conform to British Standard BS3621. This standard is expected to be superseded by a European Standard prEN12209-½ which recommends that locks for domestic use be drill resistant. Thus there is a need for a drill resistant lock.

The current trend in European lock manufacture has been to move to changing the material for the entire lock, replacing traditional soft metals such as brass with harder metals such as martensitic steels. Whilst these harder metals are inherently more resilient to attack by machining tools such as drills, their very different physical nature requires the use of different tools and methods of manufacture. It will be understood that retooling can be a costly exercise to industry. Furthermore, present methods of manufacture rely on post process machining to correct small dimensional variations between lock mechanisms and dead bolts in a batch. The use of hard steels in place of softer metals such as brass would likely require high precision casting methods which may be prohibitively expensive. It is also of note that many of these hard steels are prone to corrosion when subjected to prolonged exposure to damp atmospheric conditions. Corrosion resistance may be improved by chemical treatment of the steels but this again raises the overall manufacturing costs.

It is known to provide tamper resistant locks by including in a bolt a core of relatively hard material. For example, FR 2740498, U.S. Pat. No. 5,678,432, U.S. Pat. No. 4,446,707 and U.S. Pat. No. 3,799,592 all describe arrangements where a core of hardened steel is incorporated in a bolt. Such arrangements are described as "saw resistant". Whilst such arrangements may indeed provide resistance to sawing, it is to be understood that hardened steel is not as hard as tungsten carbide commonly used for the manufacture of drill bits and is accordingly not resistant to penetration by drilling.

GB 1338720 discloses a door lock having an insert of solid, hard ceramic. In that arrangement, the ceramic plate is, necessarily contained on all sides by a metallic material so that particles of the ceramic may be operable to act on the drill bit, even after the ceramic insert has been shattered on initial impact with the bit. Such an arrangement would not work against a drilling operation if the insert were at a surface of the bolt as the ceramic would shatter and fall out of the bolt providing access to the underlying, machinable metal body.

GB 1392268 discloses a padlock having a shackle containing a core of hardened carbide particles in a binder of solder. The carbide particles are closely packed at high density. The shackle is effective against sawing or machining operations in a similar manner to the bolt as described in GB 1338720 and suffers from similar disadvantages. The core is again, necessarily confined on all sides by the metal body of the shackle.

SUMMARY OF THE INVENTION

The present invention aims to provide a drill resistant lock which does not suffer the technical problems associated with the prior art described above.

In accordance with the present invention there is provided a drill resistant lock comprising a bolt member for fitting into a similar sized and shaped slot to secure closure of entry to a property, a locking mechanism associated with the bolt member, whereby release and/or closure of the bolt member into the slot is effected by insertion and rotation of an appropriate key in the locking mechanism, wherein the bolt member is provided with a core containing a material with different mechanical properties to the main body of the bolt member, the material of the core being more drill resistant than the material of the main body.

For the purposes of this specification, drill resistance should be understood to include resistance to any other mechanical tool used to penetrate bodies in a similar manner to a drill and is a measure of the time taken for the tool to penetrate the material to a given depth. "Core" is to be construed widely and may include any integral member or insert that is rigid and self supporting and which may be partially or totally encased in the bolt member. One or more surfaces of the core may be exposed at the surface of the bolt member.

Preferably, the main body of the bolt member is provided with one or more recesses or hollows into which the core material may be inserted. Conveniently, the lock is manufactured from brass according to conventional manufacturing methods, as a final step in the manufacture, a recess or hollow is machined into the bolt member and a suitably proportioned piece of core material is inserted. Optionally, the core material is press fit into one or more recesses or hollows machined into the bolt member.

The core material may be any material with more drill resistance greater than the material of the main body of the bolt member. The core material preferably has a drill resistance which conforms with the requirements of European Standard prEN12209-½. Preferred core materials include metal matrix composites (MMCs), most preferably MMCs comprising a soft metallic matrix in which are dispersed ceramic particles. Suitable matrices for such MMC's include but are not limited to brass or aluminium alloys. Suitable ceramics for such MMCs include but are not limited to SiC and $Al_2O_3$. Preferably, ceramic particles are provided in a proportion (by volume) of up to about 70% (typically 5%-70%) of the MMC, more preferably, between about 10% to about 50% of the MMC. Around 30-50% is desirable, although as little as 1% by volume, if suitably dispersed, is effective. Particle sizes are desirably less than about 5 mm in diameter but may be of the order of nanometers (fine powderous particles). Preferably, the particles are less than about 2 mm in diameter and desirably about 1 mm. A range of differently sized particles may optionally be included in the MMC. A range of different ceramic materials may be included in the MMC. The particles may be any shape, but are desirably angular in shape.

The ceramic particles may be uniformly or randomly spread within the matrix. Alternatively, the particles may be concentrated in one or more layers of the core material. For example a layer at a surface of the insert may comprise a concentration of ceramic particles, the remainder of the insert comprising a reduced concentration of ceramic particles. Optionally the insert of core material may comprise particles of other materials having different mechanical properties to the matrix material, for example harder metals. Also, optionally, the insert may comprise one or more layers of hard metal such as hardened steel. The inclusion of such hard metals may provide improved resistance to other tools used in lock breaking, for example saws, whilst the composite layers provide drill resistance.

Whilst the mechanism by which drill resistance is provided is not fully understood, it is postulated that the ceramic materials, being relatively harder than a typical tungsten carbide drill bit, tend to blunt or polish the bit as it rotates while in close contact with the ceramic particles. The relatively soft metal of the matrix permits redistribution of the ceramic particles to accommodate entry of the drill bit (whereas a solid ceramic insert may simply shatter). The soft metal is drawn around the drill bit clogging its cutting surface. It is to be understood that this is merely a theory on how the material operates and is not intended to impose any limit on the protection conferred to the lock as claimed in the appended claims.

The core material may be physically or chemically bonded into the bolt member or may be secured by mechanical means. Alternatively, the core material may simply be press fitted into the recess or hollow of tight tolerance.

In another aspect the invention provides a bolt member for a lock wherein the bolt member is provided with a core containing a material with different mechanical properties to the main body of the bolt member, the material of the core being more drill resistant than the material of the main body.

In another aspect, the invention provides a drill resistant insert for the bolt member of a lock, the insert comprising a material being more drill resistant than the material of the main body of the bolt member and being geometrically configured to fit in a reciprocally geometrically configured recess or hollow provided in the bolt member. Preferably, the insert comprises an MMC. Preferably the MMC has a brass, aluminium alloy or other soft metal matrix in which is dispersed particles of hard ceramic material such as SiC and $Al_2O_3$. Desirably the ceramic particles are provided in a proportion (by volume) of less than about 70%, more preferably about 40-50%. Particle sizes are desirably less than about 5 mm in diameter but may be of the order of nanometers (fine powderous particles). Preferably, the particles are less than about 2 mm in diameter. A range of differently sized particles may optionally be included in the MMC. A range of different ceramic materials may be included in the MMC. The particles may be any shape but are desirably angular. The particles may be uniformly or randomly spread throughout the matrix or may be concentrated at a surface or in a layer of the insert.

In order that further manufacturing processes may be minimised, the make up and size of the insert are selected such that a relatively thin piece of core material is needed to provide the desired drill resistance. This reduces the amount of material to be machined from the bolt member prior to insertion of the core material. Optionally the insert may comprise a laminate including at least one layer of the MMC and other composites or layers of a single material, for example a hard metal.

In another aspect, the invention provides a drill resistant material comprising a metal matrix composite (MMC) having a matrix consisting substantially of aluminium alloy or brass into which is dispersed up to about 70% by volume of ceramic particles and desirably about 30-50%, although as little as about 1% by volume, if suitably dispersed can be effective. Preferred ceramics include SiC and $Al_2O_3$. Particle sizes are desirably less than about 5 mm in diameter but may be of the order of nanometers (fine powderous particles). Preferably, the particles are less than about 2 mm in diameter more desirably about 1 mm. A range of differently sized particles may optionally be included in the MMC. A range of different ceramic materials may be included in the MMC. The particles may be any shape but preferably are angular.

For the purposes of clarification, examples of materials suitable for use in the core of a bolt member in accordance with the invention are summarised below. Each of the summarised materials was tested for drill resistance in accordance with the requirements of European Standard prEN12209-½ as summarised below:

| | |
|---|---|
| Drill Orientation | vertical |
| Drill Power | 500-700 W |
| Rotational Speed | 500-800 revs/min |
| Drill Bit | DIN 338 |
| Drill Bit Diameter | 5 mm (max) |
| Applied Load | 300 N |
| Drilling Time | ~9 min |
| No. of Drills | 3 |

The test results are summarised in Table 1 below alongside brief specifications of the materials tested.

| MATERIAL | MATRIX PHASE | PARTICLE PHASE | PARTICLE SIZE (MM) | PARTICLE FRACTION (%) | DRILLED HOLE DEPTH (MM) |
|---|---|---|---|---|---|
| M1 | Al Alloy | SiC | 1.2 | 40 | 0.9 |
| M2 | Al Alloy | SiC | 1.2 | 50 | 1.1 |
| M3 | Al Alloy | SiC | 1.2 | 60 | 2.1 |
| M4 | Al Alloy | SiC | 1.2 | 70 | 3.0 |
| M5 | Al Alloy | $Al_2O_3$ | 0.06 | 40 | 1.9 |
| M6 | Al Alloy | $Al_2O_3$ | 0.06 | 50 | 2.3 |

-continued

| MATERIAL | MATRIX PHASE | PARTICLE PHASE | PARTICLE SIZE (MM) | PARTICLE FRACTION (%) | DRILLED HOLE DEPTH (MM) |
|---|---|---|---|---|---|
| M7 | Al Alloy | $Al_2O_3$ | 0.06 | 60 | 1.8 |
| M8 | Al Alloy | $Al_2O_3$ | 0.06 | 70 | 9.7 |
| M9 | Al Alloy | SiC | 0.06 | 40 | 5.0 |
| M10 | Al Alloy | SiC | 0.06 | 50 | 2.9 |
| M11 | Al Alloy | SiC | 0.06 | 60 | 8.6 |
| M12 | Al Alloy | SiC | 0.06 | 70 | 20.0 |

DESCRIPTION OF THE FIGURES

Some embodiments of the invention will now be further described with reference to the following Figures in which.

DETAILED DESCRIPTION OF THE INVENTION

Figure 1:
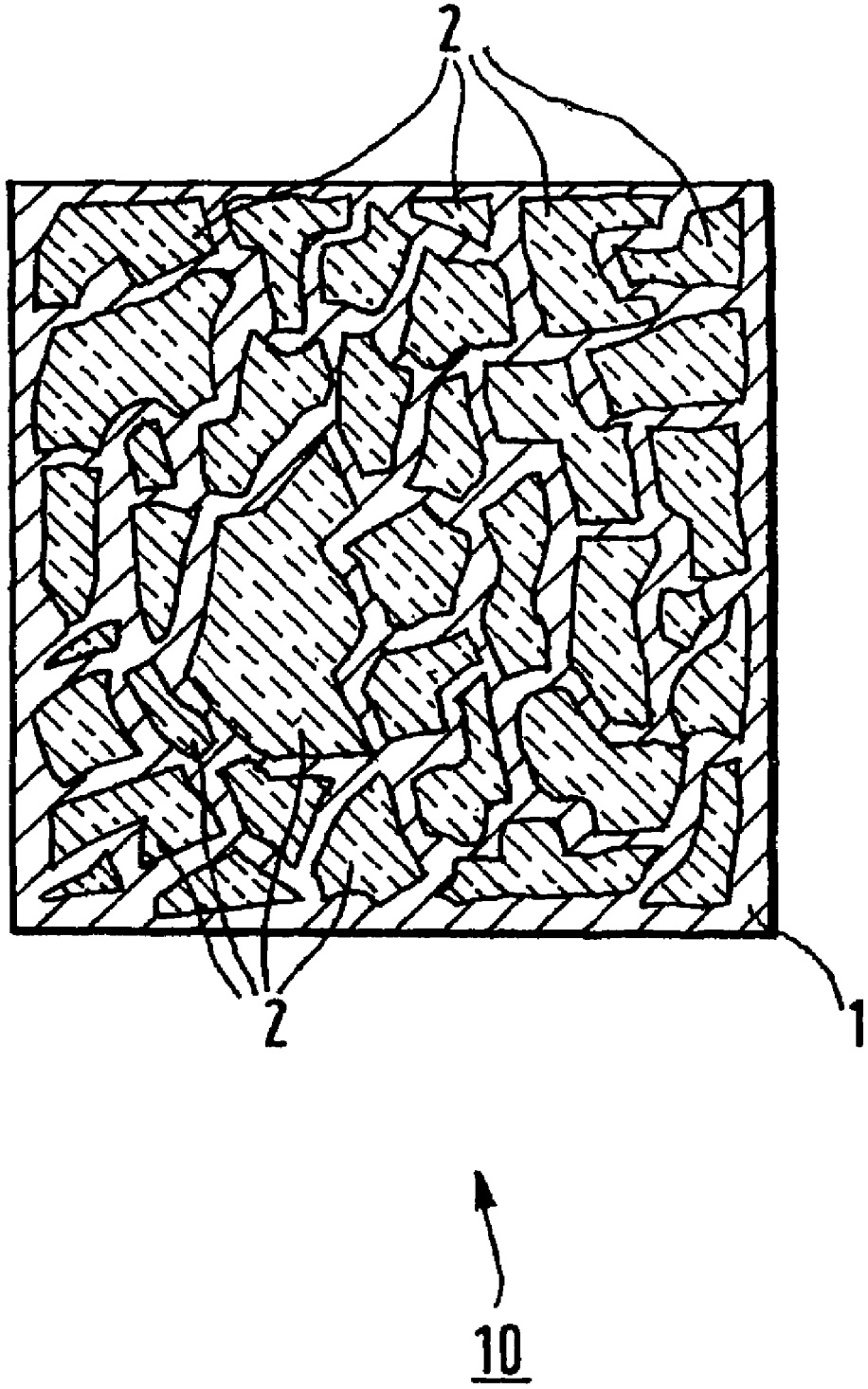
FIG. 1 provides a schematic illustration of the physical structure of an MMC suitable for use in an insert, bolt member or drill resistant lock in accordance with the invention.
Figure 2:
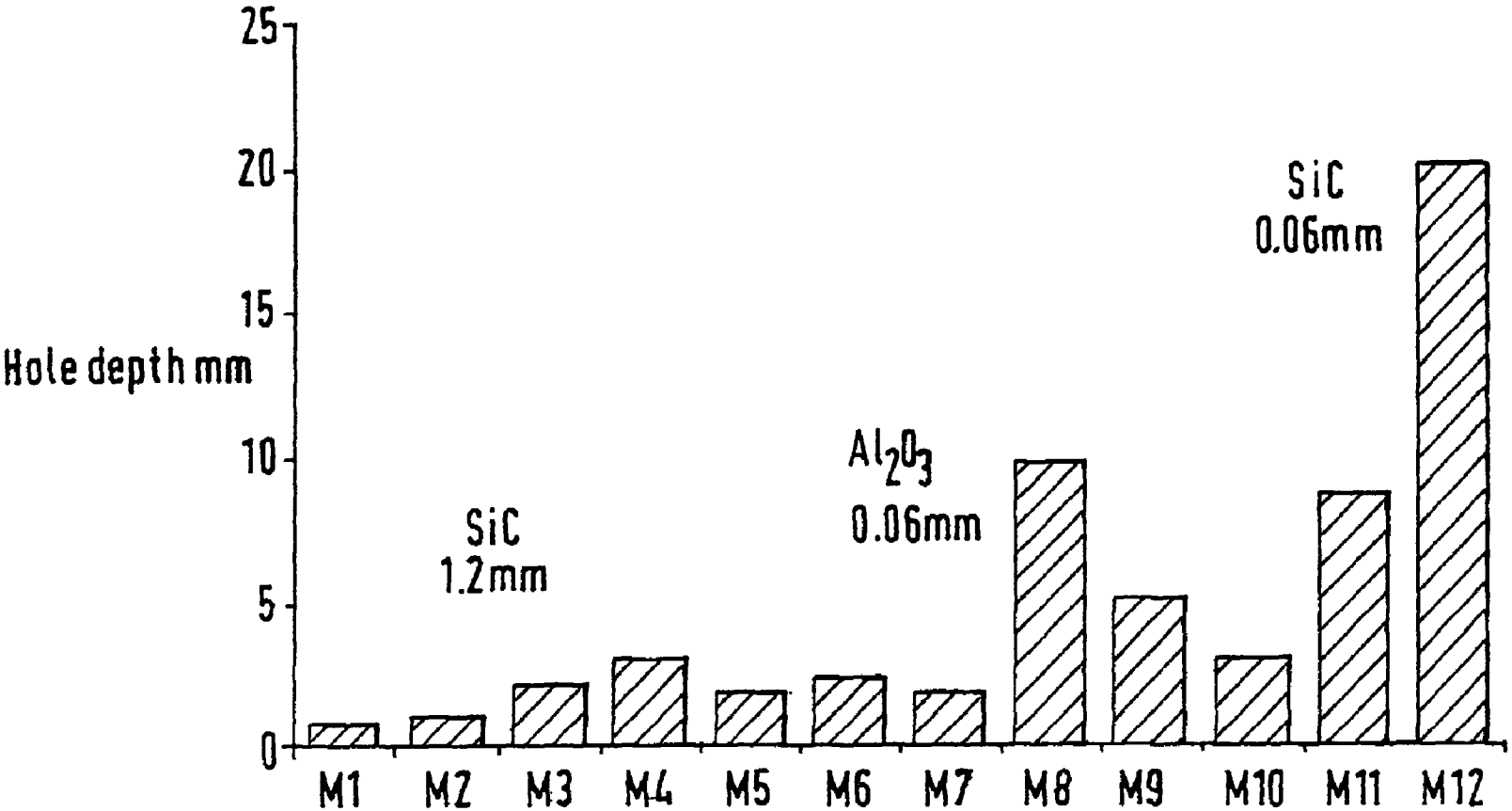
FIG. 2 provides a summary of the results of Table 1 in bar chart form.

As can be seen from FIG. 1, an MMC comprises a matrix of metallic material 1 into which is homogeneously dispersed particles of ceramic material 2. The matrix 1 provides toughness so that the material will not shatter under a high load, for example, when an attempt is made to drill the material. The ceramic particles 2 within the matrix are hard relative to materials typically used for a drill bit or other tool and resist penetration, blunting a tool used to gain unauthorised access and significantly increasing the time taken to penetrate the bolt which carries the material.

Figure 3:
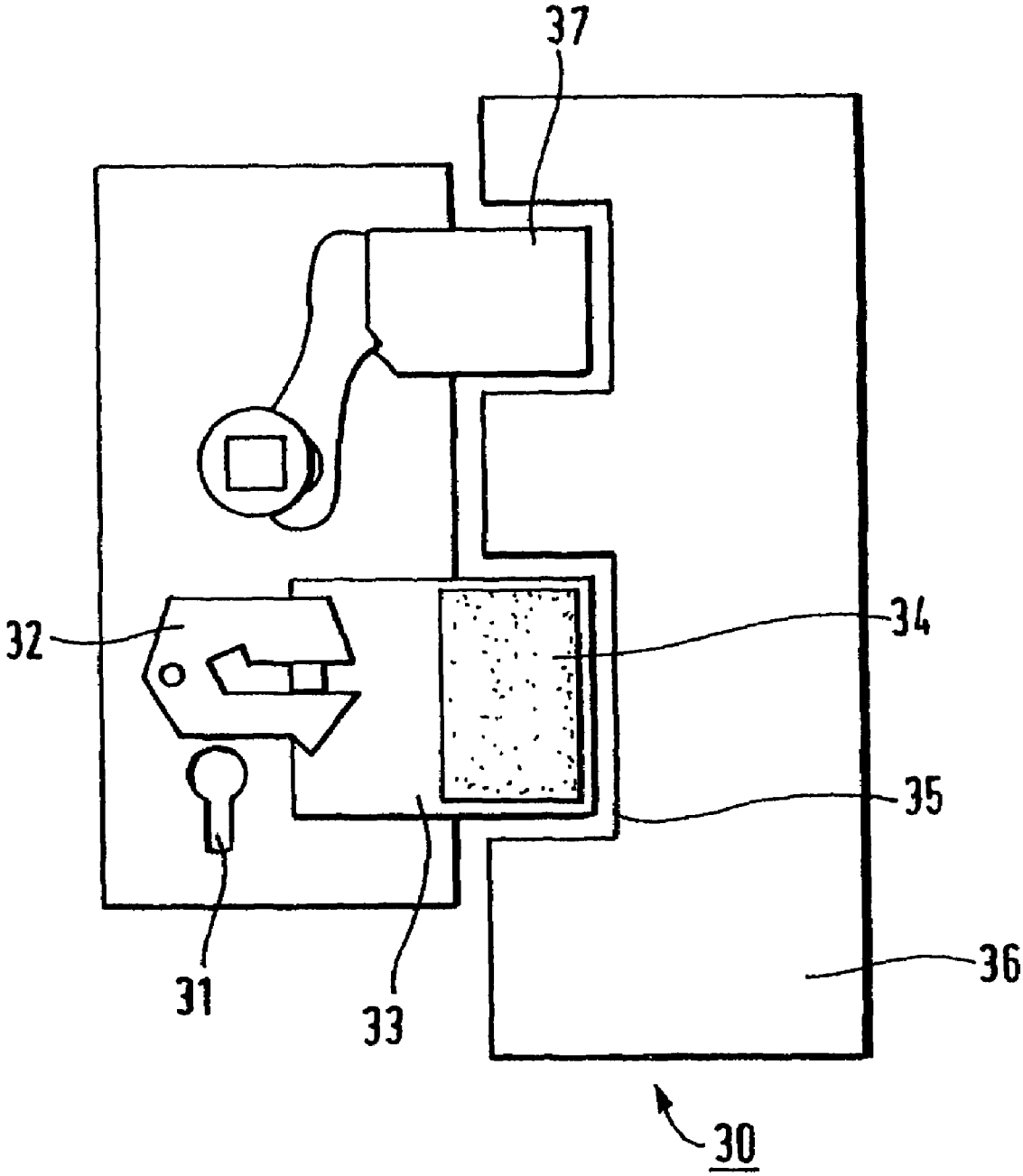
FIG. 3 provides a schematic illustration of an embodiment of a drill resistant lock in accordance with the invention.

FIG. 3 illustrates a seven lever mortise lock generally represented as 30. The lock comprises a locking mechanism consisting of a key hole 31 for receiving a key (not shown). Turning of the key operates a locking mechanism 32 which in turn switches the deadbolt 33 into or out of receiving catch 35 provided in a door frame 36. The lock also comprises a snib 37 for additional security. The deadbolt 33 carries a rectangular coupon 34 of a novel MMC as previously described. The coupon 34 may be positioned to the front, rear or centrally of the deadbolt in the portion which inserts into the catch 35. It is to be understood that it is not essential for the coupon to be rectangular, it may equally be circular, oval, square or any other convenient shape. Equally, the single coupon may be replaced with a plurality of smaller coupons with small gaps (smaller than the end of any tool likely to be used to tamper with the deadbolt) therebetween.

Figure 4:
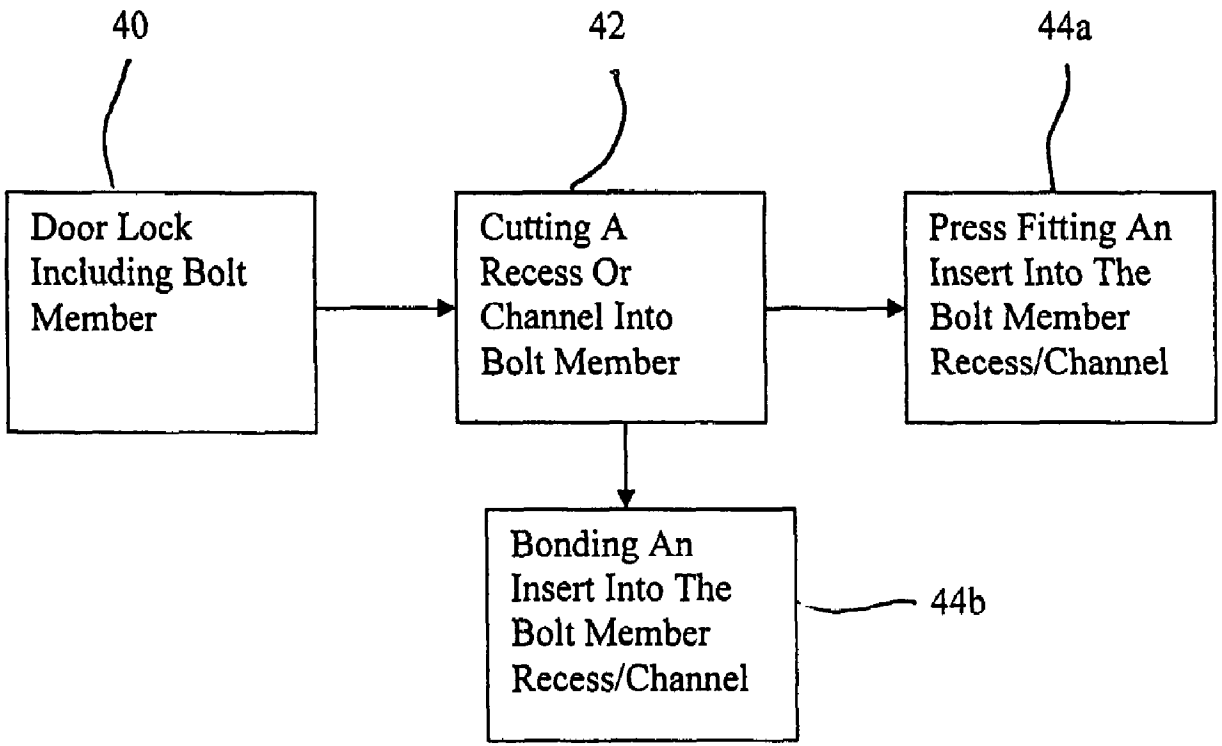
FIG. 4 is a schematic of a method embodiment of this invention for improving the drill resistance of a bolt member for door locks.

FIG. 4 illustrates a method of this invention for improving the drill resistance of a bolt member for a door lock. In FIG. 4, block 40 represents a door lock including a bolt member. In step 42, a recess or channel is cut into the bolt member. In step 44*a* and 44*b*, an insert, embodiments of which are described above, is fitted securely into the bolt member recess or channel to form a bolt member having improved drill resistance. The fitting step may be accomplished by, for example, press fitting 44*a* or by bonding the insert to the recessed or channeled surface of the bolt in step 44*b*.

The invention claimed is:

1. A drill resistant lock comprising a bolt member for fitting into a similar sized and shaped slot, a locking mechanism associated with the bolt member, whereby release and/or closure of the bolt member into the slot is effected by insertion and rotation of an appropriate key in the locking mechanism, wherein the bolt member is provided with an insert comprising a metal matrix composite (MMC) which is more drill resistant than the material of the main body of the bolt member, the insert being geometrically configured to fit in a reciprocally geometrically configured recess or hollow provided in the bolt member, and wherein the MMC comprises a soft metallic matrix in which are dispersed particles of one or more different materials having different mechanical properties to the matrix material.

2. A drill resistant lock as claimed in claim 1 wherein one or more recesses or hollows are machined into the bolt member and a suitably proportioned insert is inserted.

3. A drill resistant lock as claimed in claim 1 wherein the matrix comprises brass or an aluminum alloy.

4. A drill resistant lock as claimed in claim 1 wherein the particles are ceramic particles.

5. A drill resistant lock as claimed in claim 4 wherein the ceramic particles comprise SiC and/or $Al_2O_3$.

6. A drill resistant lock as claimed in claim 1, wherein the MMC comprises particles in a proportion by volume of less than about 70% of the MMC.

7. A drill resistant lock as claimed in claim 6 wherein the MMC comprises particles in a proportion by volume of between about 30% to about 50% of the MMC.

8. A drill resistant lock as claimed in claim 7 wherein the MMC comprises particles in a proportion by volume of about 40%.

9. A drill resistant lock as claimed in claim 1, wherein the MMC comprises ceramic particles of less than about 5 mm in diameter.

10. A drill resistant lock as claimed in claim 9 wherein the particles are less than about 2 mm in diameter.

11. A drill resistant lock as claimed in claim 10 wherein the particles are about 1 mm in diameter.

12. A drill resistant lock as claimed in claim 4 wherein the MMC comprises a range of differently sized ceramic particles.

13. A drill resistant lock as claimed in claim 4 wherein the MMC comprises a plurality of different ceramic materials.

14. A drill resistant lock as claimed in claim 1 wherein the particles are dispersed randomly or uniformly throughout the matrix.

15. A drill resistant lock as claimed in claim 1 wherein the particles are concentrated in a pre-selected region of the insert.

16. A drill resistant lock as claimed in claim 1 wherein the particles are of angular shape.

17. A bolt member for a drill resistant lock, the bolt member being provided with an insert comprising a metal matrix composite, which is more drill resistant than the material of the main body of the bolt member and comprises particles of hard ceramic material dispersed in a brass, aluminum alloy or other soft metal matrix, the insert being geometrically configured to fit in a reciprocally geometrically configured recess or hollow provided in the bolt member.

18. A method for improving the drill resistance of a bolt member for a door lock comprising:

cutting a recess or channel into the bolt member, providing an insert as specified in claim 17 configured to fit into the recess or channel; and securely fitting the insert into the recess or channel so as to form a bolt member having improved drill resistance.

19. A method as claimed in claim 18 wherein the step of securely fitting involves press fitting.

20. A method as claimed in claim 18, wherein the step of securely fitting involves bonding the insert to the recessed or channelled surface of the bolt.

* * * * *